US006210270B1

(12) United States Patent
Niksic et al.

(10) Patent No.: US 6,210,270 B1
(45) **Date of Patent: *Apr. 3, 2001**

(54) AIR BLOWER APPARATUS AND METHOD OF USE

(75) Inventors: Mark R. Niksic, Conifer; W. B. West, Littleton; Tim L. Mercer, Westminster, all of CO (US)

(73) Assignee: T. A. Pelsue Company, Englewood, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/773,261

(22) Filed: Dec. 3, 1996

(51) Int. Cl.[7] ..... F24F 7/007
(52) U.S. Cl. ..... 454/338
(58) Field of Search ..... 454/338, 903; 417/234, 423.14; 415/214.1, 212.1, 211.2

(56) References Cited

U.S. PATENT DOCUMENTS 3,096,933 * 7/1963 Bora ..... 417/247
4,662,268 * 5/1987 Beavers ..... 454/338

OTHER PUBLICATIONS

Nutmeg Utility Products literature regarding "N2760 Hose Hugger".
Leader Fan Industries, LTD product literature regarding "Manhole Ventilator and Heater".

* cited by examiner

*Primary Examiner*—Henry Bennett
*Assistant Examiner*—Malik N. Drake
(74) *Attorney, Agent, or Firm*—Dorsey & Whitney LLP

(57) ABSTRACT

An assembly for directing air to a desired location for use as an air blower, carpet drier or the like. An air blower component in a preferred embodiment includes an outlet having attachment means engageable with a separate component such as a ducting housing or carpet drier attachment, through engageable lugs.

9 Claims, 3 Drawing Sheets

AIR BLOWER APPARATUS AND METHOD OF USE

FIELD OF INVENTION

The present invention relates to the field of air blowers and, in particular, to air blowers adaptable for commercial and industrial uses such as providing fresh air to construction enclosures, drying flooded areas, and the like. One embodiment is useful with collapsible ducting and duct housing for directing fresh air through the duct to a desired site.

BACKGROUND OF THE INVENTION

Devices to produce an air current have been in existence for many years, including fans, propellers, "squirrel cages" and the like. Some such devices are for specialized purposes. The present invention relates to the specialized purposes of drying carpet and conveying air through ducting to a desired location, such as in the case of introducing fresh air to a construction enclosure or other confined space.

Such devices in the prior art typically have been highly specialized, awkward and expensive. The configuration of carpet dryers in particular is limited by their mode of use. Soaked or flooded carpets are dried by pulling up one edge of the carpet off the carpet tack strip at the carpet edge adjacent a wall, and bending the carpet slightly away from the wall to produce a space between the wall and the carpet edge. The carpet drier is configured to direct an air flow through that space and under the carpet, that is, between the carpet and the floor. The carpet drier must therefore be of such a design that it can fit between the carpet edge and the wall, yet still be of sufficient size to house a substantial fan. Because the device will be positioned close to the wall, the air inlet should not be in a side where it will be blocked by the wall. The design constraints are generally satisfied with a housing in which the axis of rotation of the fan is vertical with an air inlet in the top of the housing. Air is drawn vertically through the fan, and is then directed horizontally out the bottom of the carpet blower by a vent in a shroud located beneath the fan housing. The bottom of the shroud rests on the floor to support the entire device.

In an alternative procedure, soaked or flooded carpets are dried by blowing air over the top of the carpet, rather than by raising a carpet edge and blowing air between the carpet and the floor as described in the preceding paragraph. This alternative procedure can be accomplished with the same carpet blower apparatus described in the preceding paragraph which is used for blowing air between the carpet and the floor. The carpet drier is simply placed adjacent a wall with the shroud vent directed horizontally across the room to blow air over the top of the carpet. It can be appreciated that under either drying procedure the drier should be configured with the fan axis of rotation vertical; with the shroud vent such that air is directed horizontal; with appropriate shroud internal surfaces to translate the vertical air flow from the fan into a horizontal air flow to exit the vent; and with a minimum dimension between the vent side of the shroud and the opposite side of the shroud in order to allow placement of the vent close to the wall where the device can serve to dry areas of the carpet that are close to the wall as well as areas farther away from the wall.

Carpet driers of the "squirrel cage" type generally have a housing with an inlet at the back or on the side and a wide outlet at the front. There are several significant drawbacks to such a design. The inlet positioned low on the housing results in the uptake of moist air off the wet carpet rather than drier air from well above the carpet. Moist air is of course much less effective than drier air in drying the carpet. Because the entire housing is disposed close to the floor, the motor and other electrical components are positioned on or near the soaked carpet where they are subject to corrosion.

Air blowers are also commonly used for supplying fresh air to construction enclosures or other confined spaces. Such enclosures and spaces include tents or other temporary structures used as shelters in the service of utility boxes or to cover manholes that access water and sewer facilities or to cover excavations. Tents in particular have become increasingly popular as temporary shelters for such purposes, due to their low cost, light weight, durability and, especially with recent technological advances, very fast installation time. Such tents require a constant supply of fresh air due to their small interior volume. In the case of water and sewer facilities, a constant supply of fresh air is required due to both the small interior volume of the working space and the noxious fumes that are often present.

Air blowers are often combined with ducting for these purposes. The ducting is a length of flexible tubular-shaped fabric or plastic which is supported by a semi-rigid metal or plastic element spirally wound through the ducting. The support provides sufficient rigidity to keep the interior of ducting open to allow unrestricted air passage. The ducting can be collapsed in the axial direction for storage by reducing the spacing between spirally wound supports to thereby fold the flexible fabric or plastic wall between the spiral windings. A duct having an extended length of 20 to 30 feet can thus be collapsed for storage into a length of only 2 to 3 feet. The collapsing and extension of the duct requires little effort; the collapsing is accomplished by simply pushing the ends together and the extension is accomplished by simply pulling the ends apart. The collapsed duct may be stored in a hollow cylindrical duct housing which protects it from damage, prevents it from accidentally extending, and allows for easy transport and storage.

Like carpet driers, air blowers with ducting tend to be bulky and expensive. There is therefore a need for air blowing devices which are less bulky and expensive and which preferably use interchangeable elements to allow for multiple uses.

SUMMARY OF INVENTION

The present invention includes an apparatus and method of using the same in connection with various air blowing systems including carpet driers and fresh air blowers. A central element is a fan housing comprising an open-ended generally cylindrical body with a fan mounted therein such that the fan axis coincides with the cylinder axis. Operation of the fan draws air into the fan housing through one open end which acts as an air inlet and discharges air out the opposite open end which acts as an outlet. The fan motor is suspended in the housing interior by appropriate bracketry or other means.

The outlet end of the fan housing is configured so as to be attachable to other devices such as carpet drier attachments and ducting housing attachments. The attachment configuration in a preferred embodiment is a set of lugs which interlock with interlocking lugs on the carpet drier, ducting housing or other attachment. Other detachable attachment means are within the scope of the present invention, such as threads, snap-on designs, hook and loop fasteners, threaded fasteners such as screws or nuts and bolts, and anything else that allows secure connection between the fan housing and the desired attachment while still permitting quick and easy disengagement.

The attachment in the case of the carpet drier is a generally hollow element designed to translate a downward air flow received from the fan housing into a horizontal air flow to be directed across damp carpet or between the carpet and the floor after lifting a carpet edge. The carpet drier attachment thus includes a base which rests on the floor or carpet, and a body having an inlet facing upward to receive air from the fan housing and having an outlet facing horizontal to direct air in the horizontal direction. The body includes the attachment means described above in the region of the inlet for attaching the carpet drier attachment to the fan housing. The fan housing, attached to the carpet drier via the attachment means, is positioned with its longitudinal axis and the axis of rotation of the fan in a vertical direction. The fan housing inlet therefore faces upward and directs that air downward into the carpet drier. This positioning of the fan and motor allows the fan to draw air efficiently without obstruction from adjacent walls, and keeps the motor and other electrical components away from moisture and dirt in the flooded area. The carpet drier translates the downward moving air from the fan housing into horizontally moving air to be discharged out the air drier outlet and across the floor or carpet.

The top of the air drier attachment adjacent the air inlet includes attachment elements to engage the attachment elements on the bottom of the fan housing adjacent the fan housing outlet. The attachment elements may be bayonets to mate with bayonet lugs, or visa versa, threads, velcro, snaps or anything else that serves to detachably connect the two components.

The ducting housing is a hollow, generally cylindrical member having an air inlet at one end and an air outlet at the opposite end. Between the inlet and outlet is a space through which the air flows. The housing is of sufficient diameter to receive standard ducting of the collapsible type in which flexible plastic or fabric is supported by a semi-rigid spiral support. One end is attached to the housing interior, and the other end extends out of the housing. The collapsing and storage of the ducting in the housing is accomplished by simply applying a force to the free end to reduce the spacing between successive windings of the spiral support, thereby folding the plastic or fabric walls and reducing the overall length between the housing end and the free end of the ducting. When the ducting is fully collapsed, it is entirely within the ducting housing, where it can be secured for transport or storage.

The ducting housing generally is dispensed with its longitudinal axis horizontal. Integral or attachable feet extend from the bottom of the cylindrical body to rest the housing on the ground or other stable surface. The inlet end of the ducting housing includes appropriate attachment elements such as those described in connection with the air drier attachment. The fan housing is disposed horizontally as well, defining a horizontal longitudinal axis extending through the fan housing and ducting housing.

DETAILED DESCRIPTION OF THE INVENTION

Figure 1:
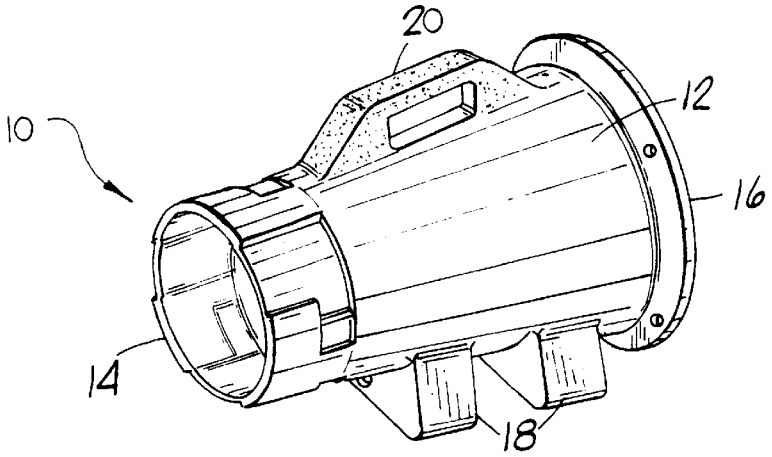
FIG. 1 is a perspective view of a fan housing in accordance with the present invention.

A perspective view of a fan housing 10 in accordance with the present invention is shown in FIG. 1. The fan housing 10 preferably includes a roughly cylindrical body 12 being flared open at the inlet end 16 in relation to the outlet end 14 to facilitate the intake of air. Feet 18 on the bottom of the body 12 support the body 12 and elevate it slightly off the ground or other resting place. A handle 20 on the top of the body 12 allows the housing 10 to be grasped and carried easily. The body 12 is preferably rotomolded plastic in materials and with thicknesses necessary to provide a rugged and rigid, but still lightweight, device.

Figure 2:
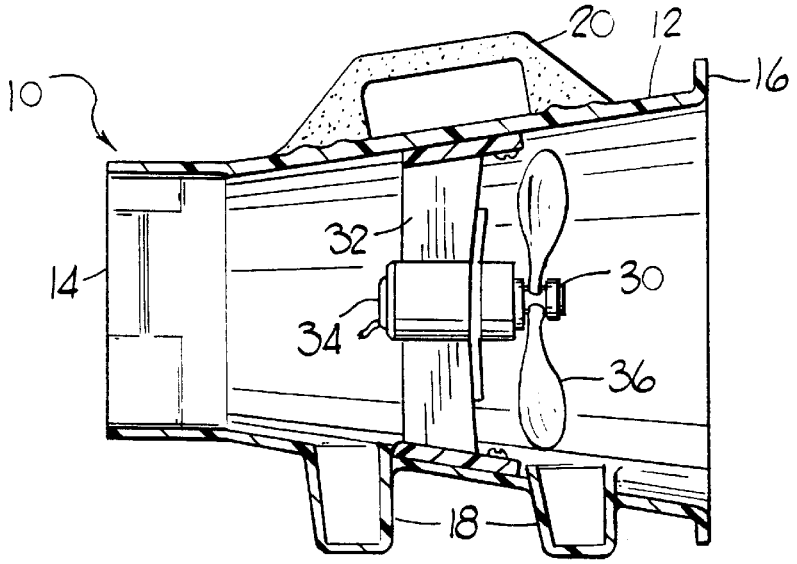
FIG. 2 is a side sectional view of the fan housing of FIG. 1.

FIG. 2 shows a side sectional view of the fan housing 10 in which the interior, fan and fan mount is visible. It can be seen that the fan 30 is centrally mounted in the interior of the body 12 of the fan housing 10 by a set of brackets 32 extending from a motor housing 34 to the sidewalls of the body 12. The fan 30 includes a set of blades 36 which are driven in the standard manner by the electric motor 34 in communication with a suitable power supply (not shown). Air is drawn into the fan housing 10 through the inlet 16 by the fan blades 36, passes through the body 12 of the housing 10 between the bracketry 32, and is discharged out the outlet 14.

Figure 3:
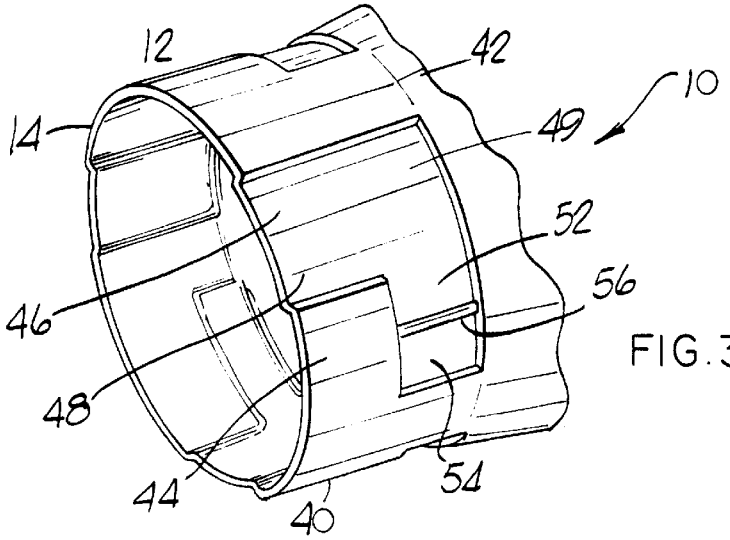
FIG. 3 is a detail view of the fan housing of FIG. 1.

FIG. 3 shows a preferred interlocking attachment means on the outlet 14 end of the fan housing 10. The body 12 includes a neck 40 at the outlet 14 end, wherein the body 12 is not flared but is instead substantially cylindrical. The neck 40 of the body 12 joins the flared portion of the body 12 at a boundary 42. The neck 40 includes raised portions 44 which are raised in relation to recessed portions 46. The difference between the raised portions 44 and the recessed portions 46 is fairly slight, on the order of an eighth inch in a preferred embodiment. Each recessed portion 46 defines an L-shape which is configured to receive an engaging lug on the attachment to the fan housing, as discussed further below. The lug is preferably a square-shaped raised portion on an interior surface of the attachment. When the attachment is slid over the outlet 14 end of the fan housing 10, the raised lug on the attachment interior slides into a leg of the L-shaped recess 46 on the fan housing 10 neck 40 in the region of leg 48. Further sliding of the attachment onto the fan housing 10 positions the lug in the region of the L-shaped recess 46 which is designated 49. The attachment and fan housing 10 can then be rotated in relation to one another along their longitudinal axis, such that the lug moves to leg 52 of the recessed portion 46. A linear raised portion 56 divides recessed portion 52 from recessed portion 54. Further rotation of the attachment in relation to the fan housing 10 causes the attachment lug to snap over this linear raised portion 56, thereby snugly locking the components together.

It should be appreciated that although a single engagement mechanism is described above and shown in the figures, the preferred embodiment utilizes a plurality of such engagement mechanisms spaced around the exterior surface of the neck 40 of the fan housing 10. corresponding engagement means are on the interior surface of the attachment. The attachment and fan housing 10 are thus securely attached to one another in a manner which prevents any accidental disengagement, rocking or slipping.

Figure 4:
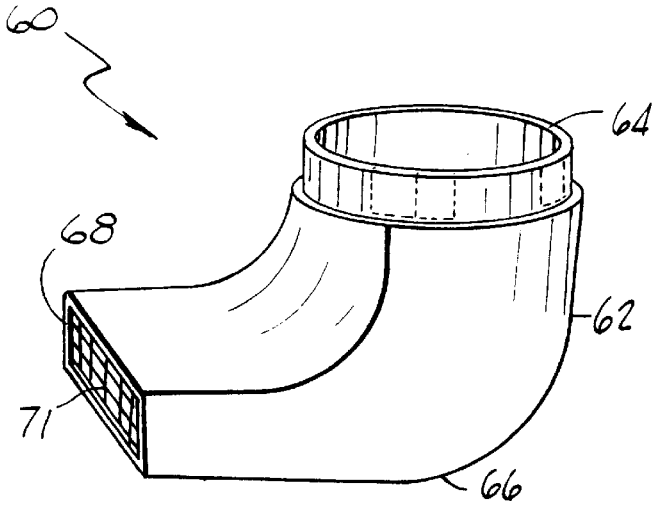
FIG. 4 is an air drier in accordance with the present invention.

An air drier 60 in accordance with the present invention is shown in FIG. 4. The air drier 60 includes a body 62 having an inlet 64 at the upper end, a base 66 and an outlet 68. The outlet is an approximately rectangular opening with its long side horizontal, in communication with a hollow interior of the body 62. The inlet 64 is substantially circular and opens into the interior of a drier neck 70 which leads to the interior of the body 62. Air is thus free to pass from the inlet 64 to the outlet 68 with a minimum of interference. The surface of the drier 60 body 62 is configured with a smooth transition between the inlet 64 and outlet 68 as shown in FIG. 4.

Figure 6:
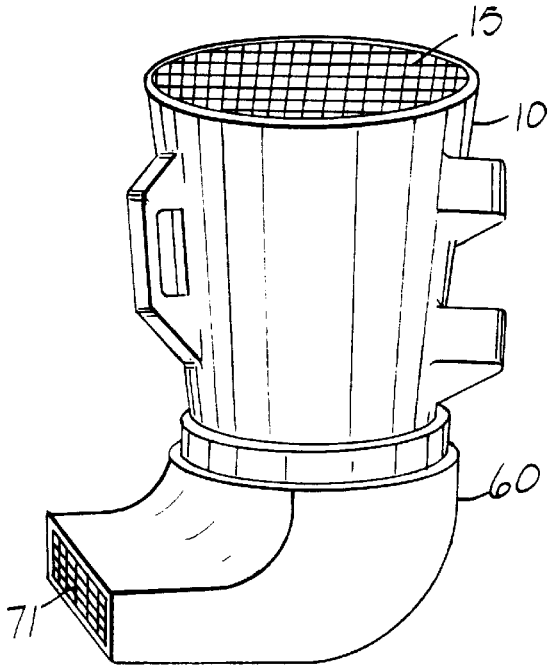
FIG. 6 is a perspective view of an assembled air blower and air drier in accordance with the present invention.
Figure 5:
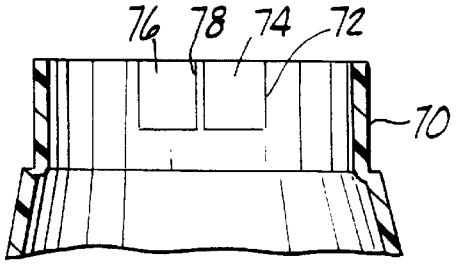
FIG. 5 is a detail view of the air drier of FIG. 4.

The detailed side view of FIG. 5 shows the interior surface of neck 70 of the drier 60. The neck preferably includes raised portions or lugs 72 in relation to the rest of the surface of the neck 70. Such lugs 72 interlock with the engaging surfaces of the fan housing 10 of FIGS. 1–3 in the manner described above. Each lug 72 include two components, 74 and 76, separated by a groove 78 which locks into the raised linear portion 56 of the fan housing 10 (see FIG. 3 and discussion above). FIG. 6 shows the fan housing 10 attached to the drier 60. It can be appreciated that the combined components accomplish the desired objectives of a device which directs air horizontally over the floor but draws air through an inlet which is unobscured by adjacent walls. Also visible in FIG. 6 is the inlet grill 15 which shields the fan blades 36 (see FIG. 2) and outlet grill 71 for the drier 60.

Figure 7:
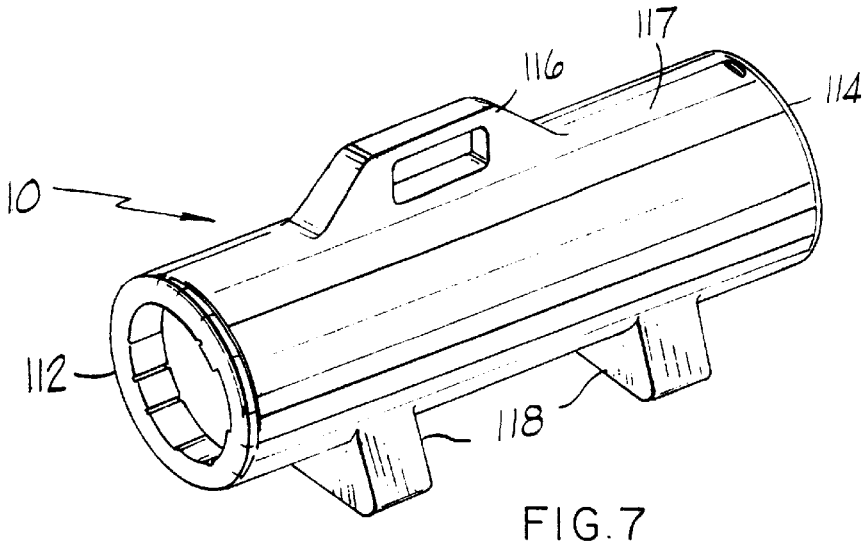
FIG. 7 is a perspective view of a ducting housing in accordance with the present invention.

Next described is the invention in the context of flexible ducting and a ducting housing. Shown in FIG. 7 is a perspective view of a ducting housing 110 in accordance with the invention. The ducting housing 110 is generally cylindrical shaped with an inlet 112 and an outlet 114. A handle 116 facilitates the handling of the device, and a pair of feet 118 are provided on the bottom to rest the device on the ground or other surface.

Figure 8:
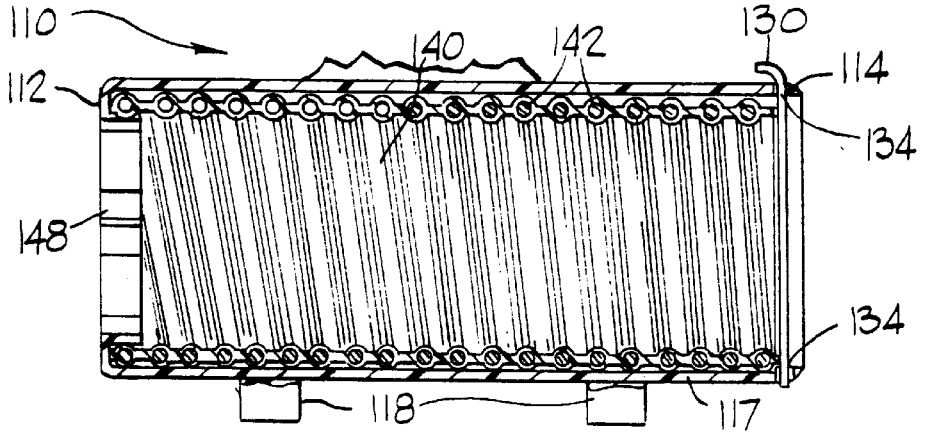
FIG. 8 is a side sectional view of the ducting housing of FIG. 4.

A side sectional view of the ducting housing 110 is shown in FIG. 8. The sectional view shows the collapsed ducting 140 positioned inside the body of the ducting housing 110. The ducting consists of flexible fabric or plastic sidewalls 144 which are raised into a tubular configuration by semi-rigid support 142 spirally wound therethrough. One end of the ducting 140 is attached to the inlet end of the body 117. When the ducting is collapsed into the body 117 as shown in FIG. 8, the other end of the ducting 140 is held inside the body 117 by a cross-bar 130 which extends through a pair of slots 134 in the outlet end of the body 117. The inlet end of the body 117 includes attachment means for attaching the ducting housing 110 to the air blower 10 (see FIG. 9). In the preferred embodiment, the attachment means is a set of lugs 148 similar to the lugs of the carpet drier described above and shown in FIG. 5.

Figure 9:
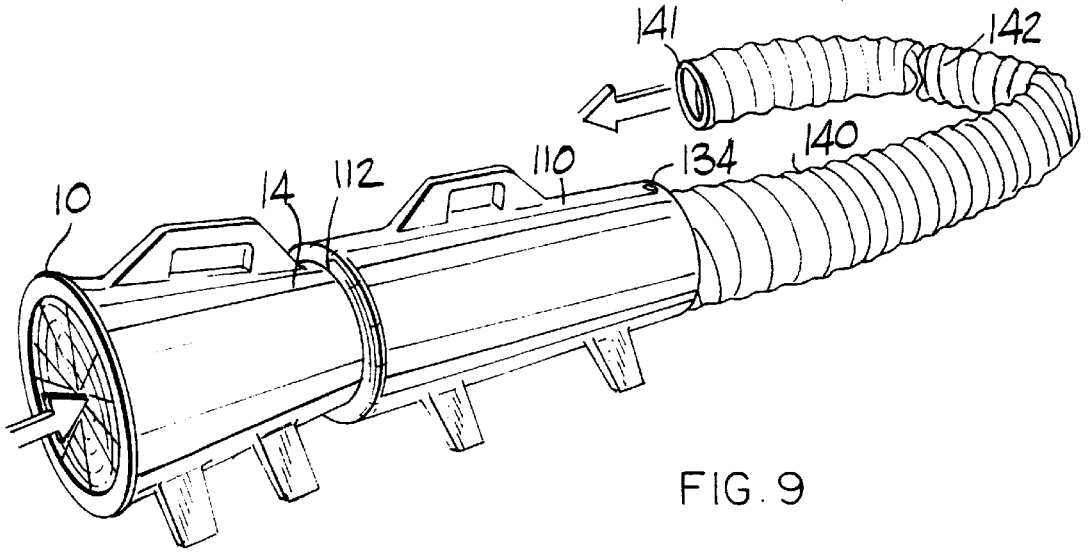
FIG. 9 is a perspective view of an assembled air blower and ducting housing in accordance with the present invention.

FIG. 9 is an overall perspective view of the air blower 10 and ducting housing 110 components in an assembled state. The ducting housing 110 attaches to the air blower 10 via their engagable attachment means (see FIGS. 3, 5 and 8) whereby the inlet 112 of the ducting housing body 117 connects to the outlet 14 of the air blower body 12. In this assembled position, air is drawn into the air blower inlet 16, through the fan blades 36 by the propulsion of the motor 34 (see FIG. 2) and out the fan housing outlet 14. Because the fan housing outlet 14 is in communication with the ducting housing inlet 112, the air thereupon enters the ducting 140. It is further propelled through the ducting 140, and finally out the ducting outlet 141. The ducting outlet 141 is situated where fresh air is desired, such as in an enclosed construction shelter, sewer system or other location.

What is claimed is:

1. An air blower device for attachment to an accessory comprising:

a hollow body having an air inlet and air outlet;

a blower positioned within the body to draw air in the inlet and expel air out the outlet; and releasable attachment means for releasably attaching the air blower device to the accessory;

wherein the releasable attachment means includes a set of lugs engageable with a set of engaging lugs on the accessory.

2. The air blower of claim 1, wherein the lugs include one of a set of recesses and raised portions to engage the other of a set of recesses and raised portions on the engaging lugs.

3. The air blower device of claim 2, wherein the recessed portions include a bead engageable with a groove in the raised portion.

4. The air blower of claim 2, wherein one of the recessed portions and raised portions includes a first portion substantially parallel to a longitudinal axis of the air blower device and a second portion substantially perpendicular to the first portion into which the other of the recessed portion and raised portion can be secured.

5. The air blower of claim 4, wherein the secured portion in one of the recessed portion and raised portion includes one of a bead and a groove to engage the other of a bead and a groove in the other of the recessed portion and raised portion.

6. A ducting housing attachable to an air blower comprising: a hollow body having an air inlet at one end and an air outlet at an opposite end; ducting collapsible in an axial direction into the body and extendable in the axial direction from the body, the ducting having an end attached to the body and an opposite end extendable from the body; and lugs for releasably attaching the ducting housing to an air blower.

7. The ducting housing of claim 6, further comprising securing means for securing the ducting in the body.

8. The ducting housing of claim 7, wherein the securing means includes a slot in the body adjacent the outlet and a securing bar slidably positionable in the slot across the inlet.

9. An air blower and ducting assembly, comprising: a hollow air blower body having an air inlet and air outlet, and a blower positioned within the body to draw air in the inlet and expel air out the outlet; a ducting housing having a hollow body with an air inlet of one end and an air outlet at an opposite end, and ducting collapsible in an axial direction into the body and extendable in the axial direction from the body; and lugs adjacent the air blower outlet and ducting housing inlet for releasably attaching the air blower outlet to the ducting housing inlet.

* * * * *